US009379506B2

(12) United States Patent
Lehmann et al.

(10) Patent No.: US 9,379,506 B2
(45) Date of Patent: Jun. 28, 2016

(54) METHOD FOR ELECTRICALLY CONNECTING A CABLE TO A CONTACT ELEMENT

(71) Applicant: Lisa Dräxlmaier GmbH, Vilsbiburg (DE)

(72) Inventors: Lutz Lehmann, Vilsbiburg (DE); Georg Scheidhammer, Bodenkirchen (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 225 days.

(21) Appl. No.: 14/282,501

(22) Filed: May 20, 2014

(65) Prior Publication Data

US 2014/0345128 A1 Nov. 27, 2014

(30) Foreign Application Priority Data

May 21, 2013 (DE) ..... 10 2013 209 314

(51) Int. Cl.
*H01R 43/02* (2006.01)
*H01R 43/28* (2006.01)

(52) U.S. Cl.
CPC ..... *H01R 43/02* (2013.01); *H01R 43/0207* (2013.01); *H01R 43/28* (2013.01); *H01R 2201/26* (2013.01); *Y10T 29/49179* (2015.01)

(58) Field of Classification Search
CPC ..... B21F 15/00; H01R 43/0207; Y10T 29/49179; Y10T 29/49185; Y10T 29/49204; Y10T 29/49174; Y10T 29/49194
USPC ..... 29/860, 854, 857, 873, 874, 876, 878; 439/263, 427, 429, 430
See application file for complete search history.

(56) References Cited

U.S. PATENT DOCUMENTS 7,500,868 B2 * 3/2009 Holland ..... H01R 4/2412 439/427
8,137,125 B2 * 3/2012 Takehara ..... H01R 4/5033 174/94 S

FOREIGN PATENT DOCUMENTS

DE 102008031588 A1 1/2010

* cited by examiner

*Primary Examiner* — Thiem Phan
(74) *Attorney, Agent, or Firm* — Finnegan, Henderson, Farabow, Garrett & Dunner LLP

(57) ABSTRACT

A method for electrically connecting a strand of an electrical conductor to a contact element. The strand includes a plurality of single wires. The method includes dividing the strand into at least a first part including a first group of the single wires and a second part including a second group of the single wires, welding the first group of the single wires to a first contact surface of the contact element, and welding the second group of the single wires to the first group of the single wires or to a second contact surface of the contact element, the second contact surface being opposite to the first contact surface.

7 Claims, 1 Drawing Sheet

METHOD FOR ELECTRICALLY CONNECTING A CABLE TO A CONTACT ELEMENT

CROSS-REFERENCE TO RELATED APPLICATIONS

This application is based upon and claims the benefit of prior German Application No, 10 2013 209 314.4, filed on May 21, 2013, the entire contents of which are incorporated herein by reference.

FIELD OF TECHNOLOGY

The disclosure relates to a method for electrically connecting a strand of an electrical conductor to a contact element by means of a welding process and, more particularly, by means of an ultrasound welding process. In that context, a strand refers to an electrical conductor that is formed by a plurality of single wires.

BACKGROUND

In automotive construction, in order to save weight as well as replace expensive metals with more economical alternatives, there has long been the desire to make electrical cables from light metals, such as aluminum, for example, and their alloys. However, when these cables come into electrical contact with a contact element, which are in particular in motor vehicles subjected to dynamic stress over a long period of many years, there are problems in maintaining the contact. One cause of such problems is the cold-flow tendency of the material, i.e., the tendency of light metals, such as aluminum, to relieve mechanical stresses in the structure even at low temperatures. Another cause is an oxide layer that is present primarily with aluminum alloys on the surface of the aluminum alloy. A further cause is the risk of electrochemical corrosion in the connecting area of the light metal strands and the contact elements in the presence of electrolytes. Therefore, there has long been a desire to provide a lasting consistent contact between light metal strands and contact elements even under the circumstances described above.

DE 10 2008 031 588 A1 discloses using ultrasound welding as a technology for joining aluminum strands. With this method, a certain ratio must be maintained between the welding width and the welding height to obtain a sufficient joining quality. In particular, with large conductor diameters from approximately 50 $mm^2$, the required welding width quickly exceeds the actually required total width of the contact element, and thus the welding becomes the determining factor of the physical size and also creates problems with respect to sealing. In automotive electrical technology, an optimally small physical size is desired.

SUMMARY

One object of the disclosure is to provide a method that can be executed in a simple and cost efficient manner, and leads to an optimally narrow physical size with large strand diameters.

This object is achieved with a method consistent with embodiments of the disclosure. Advantageous modifications of the disclosed embodiments are described in the description below and the illustrations.

The disclosure is based on the idea of dividing the strand into at least two partial packets, each of which comprises a plurality of single wires, and to connect the individual packets to the contact element and/or to each other in separate welding processes.

Accordingly, the disclosure proposes a method for electrically and mechanically connecting the strand of an electrical conductor to a contact element, with the strand comprising a plurality of single wires. In some embodiments, the single wires are made of aluminum and/or an aluminum alloy. The actual contact element can also be made of aluminum and/or an aluminum alloy or of another electrically conductive material. The method comprises as a first step that the strand is divided into at least two parts, each of which comprises a plurality of the single wires. In other words, at least two packets of single wires are formed from the strand. After the dividing, the single wires of a first part of the divided strand (a first packet of single wires) are welded to a first contact surface of the contact element. Thereafter and in a separate process step, the single wires of a second part (a second packet of single wires) are welded to the single wires of the first part of the divided strand (the first packet of single wires) welded to the contact element, or to another contact surface of the contact element, for example a second contact surface of the contact element opposite the first contact surface. In this manner, the welding process can be realized at relatively large strand diameters with relatively low welding widths. The welding parameters are determined according to a strand diameter of the parts of the strand (the packets of single wires). In this manner, the required welding widths can be reduced by 30 to 40% because only a fraction of the original diameter has to be taken into account in the design of the welding widths. For example, in a conventional method, in order to achieve a good welding quality, a welding width of 22 mm is normally required for a total strand diameter of 85 $mm^2$. However, with the method consistent with embodiments of the disclosure, a welding width of 15 mm is enough.

In some embodiments, an ultrasound welding process is used to weld each part of the divided strand.

In some embodiments, the method further includes folding away the second part of the divided strand before the single wires of the first part of the divided strand are welded, and folding back the second part of the divided strand before the single wires of the second part of the divided strand are welded.

In some embodiments, the strand is divided into at least two essentially equal parts. In this context, "essentially" refers to a deviation of up to maximally ±10%. The deviation may be due to the fact that, without a precise count of the single wires or with an uneven number of single wires, a precise division is not possible. Dividing the strand into essentially equal parts allows the welding process to be executed with equal parameters and therefore to be easier to control.

In some embodiments, the single wires of the first part and the second part of the divided strand are welded simultaneously to the contact surface of the contact element, for example, with two ultrasound welding heads operating in anti-phase. In this manner, the contact is created faster and the cycle times in production can be shortened.

Additional characteristics, which can be implemented either alone or in combination with one or more of the characteristics described above, as well as advantages of the disclosure, follow from the description of the embodiments below with reference to the accompanying drawings.

DESCRIPTION OF EMBODIMENTS

Figure 1:
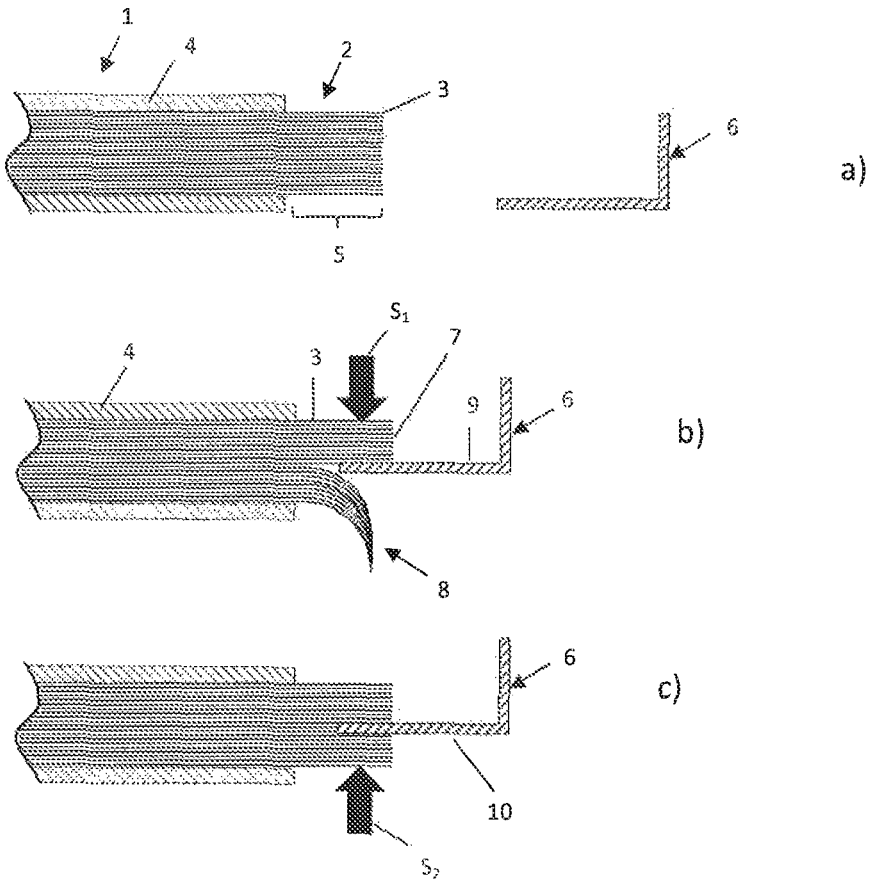
FIGS. 1*a*-1*c* show a method according to an exemplary embodiment.

FIG. 1*a* shows a cable 1. The cable 1 is formed by a strand 2 including a plurality of single wires 3 made of aluminum or an aluminum alloy. Furthermore, the cable 1 has an electrical insulation 4, which is removed in a connecting segment 5 so that the single wires 3 of the strand 2 are exposed in the connecting segment 5. Furthermore, a contact element 6 is shown schematically in FIG. 1*a*. The contact element 6 can also be made of aluminum or an aluminum alloy, and may be a fork terminal, a plug, or another electrical contact element.

As shown in FIG. 1*b*, the strand 2 is first divided into several parts (two in the present case) 7 and 8. Each of the parts 7 and 8 includes some of the single wires 3. As shown in FIG. 1*b*, part 8 and/or its single wires 3 are folded away in a downward direction.

Then, as shown in FIG. 1*b*, a first contact surface 9 of the contact element 6 is brought into contact with the first part 7 and/or its single wires 3. Then a first ultrasound welding process $S_1$ shown by the block arrow in FIG. 1*b* is performed to connect the first part 7 to the first contact surface 9 of the contact element 6 by means of ultrasound welding. Then the single wires 3 of the second part 8 are folded back into contact with a second contact surface 10 of the contact element 6 that opposes the first contact surface 9, as shown in FIG. 1*c*. a second ultrasound welding process $S_2$ is performed to weld the single wires 3 of the second part 8 to the second contact surface 10 of the contact element 6 by means of ultrasound welding.

As discussed above, welding the strand 2 by dividing the strand 2 into two individual packets (the parts 7 and 8) according to embodiments of the disclosure uses a smaller welding width as compared to conventional methods. For example, if the strand 2 has a diameter of 85 $mm^2$, a conventional method requires a welding width of at least 22 mm in the ultrasound welding process, while a method according to embodiments of the disclosure allows a reduction of the welding width to 15 mm.

In some embodiments, the first and second ultrasound welding processes $S_1$ and $S_2$ can be performed simultaneously with two ultrasound welding heads operating in anti-phase.

Figure 2:
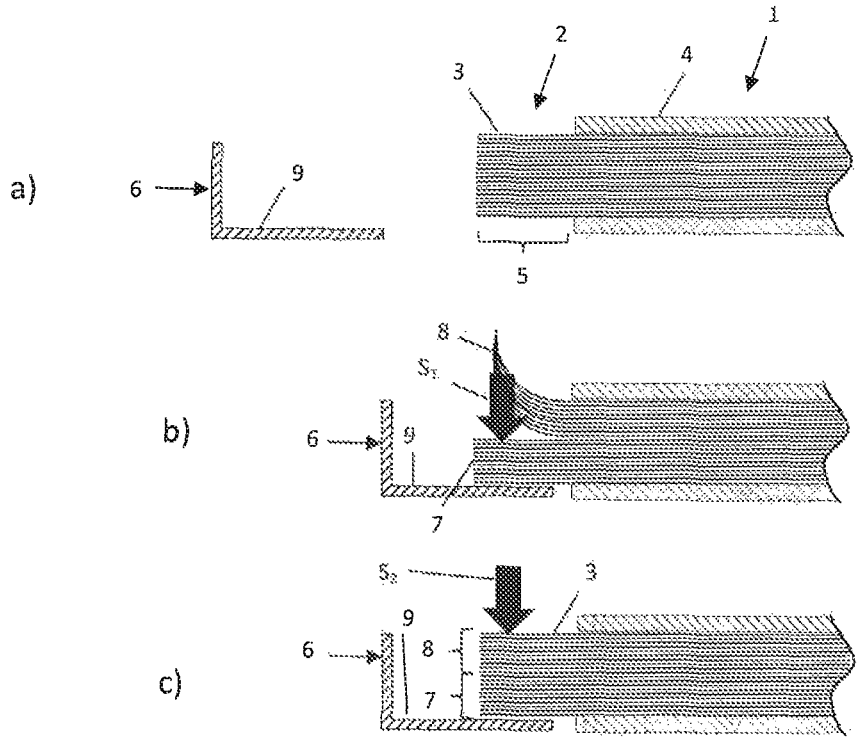
FIGS. 2*a*-2*c* show a method according to another exemplary embodiment.

FIGS. 2*a*-2*c* show another exemplary method consistent with embodiments of the disclosure. As shown in FIG. 2*b*, the second part 8 is first folded away in an upward direction and the first part 7 is cold-welded to the first contact surface 9 in a first ultrasound welding process $S_1$. Then the second part 8 and/or its single wires 3 are folded back so that they are on the first part 7 and/or its single wires 3. In a second ultrasound welding process $S_2$, the single wires 3 of the second part 8 are cold-welded to the single wires 3 of the first part 7. Here too, it is possible to reduce the welding width from 22 mm to 15 mm with an 85 $mm^2$ diameter of the strand 2, for example, and still realizing a secure mechanical and electrical contact.

Furthermore, consistent with embodiments of the disclosure, the strand 2 is divided into two essentially equal parts. Therefore, identical parameters can be selected for the welding processes $S_1$ and $S_2$. This is because the welding parameters are determined by the diameter of the parts 7 and/or 8 of the divided strand 2, i.e., using a smaller strand diameter. This also reduces the required energy supply.

Other embodiments of the disclosure will be apparent to those skilled in the art from consideration of the specification and practice of the disclosed embodiments herein. It is intended that the specification and examples be considered as exemplary only, with a true scope and spirit of the disclosed embodiments being indicated by the following claims.

What is claimed is:

1. A method for electrically connecting a strand of an electrical conductor to a contact element, the strand including a plurality of single wires, the method comprising:

dividing the strand into at least a first part including a first group of the single wires and a second part including a second group of the single wires;

welding the first group of the single wires to a first contact surface of the contact element; and welding the second group of the single wires to the first group of the single wires or to a second contact surface of the contact element, the second contact surface being opposite to the first contact surface.

2. The method according to claim 1, wherein:

welding the first group of the single wires includes welding the first group of the single wires using a first ultrasound welding process, and welding the second group of the single wires includes welding the second group of the single wires using a second ultrasound welding process.

3. The method according to claim 1, further comprising:

folding away the second part before welding the first group of the single wires; and folding back the second part before welding the second group of the single wires.

4. The method according to claim 1, wherein the single wires are made of aluminum or an aluminum alloy.

5. The method according to claim 1, where dividing the strand includes dividing the strand into at least two essentially equal parts.

6. The method according to claim 1, wherein welding the first group of the single wires and welding the second group of the single wires include welding the first and second groups of the single wires simultaneously.

7. The method according to claim 6, wherein welding the first and second groups of the single wires includes performing the weldings using two ultrasound welding heads operating in anti-phase.

* * * * *